US006615894B1

(12) United States Patent
McKeon

(10) Patent No.: US 6,615,894 B1
(45) Date of Patent: Sep. 9, 2003

(54) SELF-CLOSING SINGLE-SIDED ACCORDION FIRE DOOR

(75) Inventor: James McKeon, Forest Hills, NY (US)

(73) Assignee: McKeon Rolling Steel Door Co., Inc., Brooklyn, NY (US)

( * ) Notice: Subject to any disclaimer, the term of this patent is extended or adjusted under 35 U.S.C. 154(b) by 0 days.

(21) Appl. No.: 09/738,663

(22) Filed: Dec. 15, 2000

(51) Int. Cl.[7] ..... E05F 15/20
(52) U.S. Cl. ..... 160/1; 160/235; 160/236
(58) Field of Search ..... 160/1, 7, 5, 6, 160/9, 84.01, 84.04, 84.08, 188, 199, 235, 133, DIG. 16

(56) References Cited

U.S. PATENT DOCUMENTS

| | | | | |
|---|---|---|---|---|
| 3,447,584 A | | 6/1969 | Smart | |
| 3,481,388 A | | 12/1969 | Smart | |
| 3,509,934 A | | 5/1970 | Smart | |
| 3,738,413 A | * | 6/1973 | Frobosilo | 160/235 X |
| 3,782,444 A | * | 1/1974 | Rapp et al. | 160/235 |
| 3,799,237 A | * | 3/1974 | Proserpi | 160/235 X |
| 3,807,480 A | | 4/1974 | Smart | |
| 3,861,443 A | * | 1/1975 | Tarnoff | 160/1 |
| 3,866,656 A | * | 2/1975 | McCabe | 160/1 X |
| 3,907,020 A | * | 9/1975 | Root | 160/1 |
| 3,972,365 A | * | 8/1976 | Dixon | 160/235 X |
| 4,027,714 A | | 6/1977 | Dixon et al. | |
| 4,106,544 A | | 8/1978 | Dixon et al. | |
| 4,224,767 A | * | 9/1980 | Jecmen et al. | 49/488 |
| 4,333,392 A | * | 6/1982 | Nailor et al. | 98/1 |
| 4,467,562 A | * | 8/1984 | Hemmerling | 49/411 |
| 4,763,711 A | * | 8/1988 | Hart et al. | 160/1 |
| 4,867,221 A | | 9/1989 | Dixon et al. | |
| 5,085,261 A | * | 2/1992 | Bortoluzzi | 160/199 |
| 5,259,433 A | * | 11/1993 | Cloutier | 160/190 |
| 5,355,927 A | * | 10/1994 | McKeon | 160/7 |
| 5,542,460 A | | 8/1996 | McKeon | |
| 5,601,130 A | * | 2/1997 | Werner et al. | 160/183 |
| 5,673,740 A | * | 10/1997 | Park | 160/133 X |
| 6,000,505 A | | 12/1999 | Allen | |
| 6,223,804 B1 | * | 5/2001 | Toti | 160/199 |
| 6,422,289 B1 | * | 7/2002 | Miller | |

OTHER PUBLICATIONS

Saino Manufacturing, "Other Products Doors and Operators", p. 16 of catalog 08370/SAJ, one (1) page advertisement.
Shutter Doors Ltd., "Folding Shutter Doors", eight (8) pages, Oct. 1991 advertisement.
Southern Sampson, "Fire Resisting Shutters", four pages, advertisement.

* cited by examiner

*Primary Examiner*—Bruce A. Lev
(74) *Attorney, Agent, or Firm*—Cohen, Pontani, Lieberman & Pavane

(57) ABSTRACT

An accordion fire door is provided including an accordion member having interlocking panels formed of a fire retardant or fire proof material, a guide member positioned on at least one side of the accordion member for guiding the accordion member during movement between an opened position and a closed position, end locks arranged at interconnected ends of adjacent panels for maintaining panel contact and alignment, and a releasing member connected to the accordion member for releasing the accordion member in response to a predetermined condition of at least one of heat, fire, smoke, manual initiation and a drive. The panels are self hinged along the entire interlocking sides.

19 Claims, 9 Drawing Sheets

SELF-CLOSING SINGLE-SIDED ACCORDION FIRE DOOR

BACKGROUND OF THE INVENTION

1. Field of the Invention

The present invention relates to an accordion fire door. More particularly, the present invention relates to an accordion door that is resistant to fire, heat and/or smoke and is self closing when actuated by exposure to certain conditions of fire, heat and/or smoke. The door may be readily reopened and closed manually after actuation.

2. Description of the Related Art

Fire doors are used as protective devices to localize a fire and/or smoke threat within a structure such as a building. Various types of fire doors are provided to close different kinds of openings generally found in buildings. For example, for a vertical opening having a relatively short width in relation to its height, a vertical fire door is often provided which can close in the direction from top to bottom. For a vertical opening that has a relatively large width or that is irregularly shaped, a horizontal fire door which closes from side to side is appropriate. In the United States, these doors are required to meet certain fire code standards which include, among other things, the doors withstanding certain elevated temperatures and resisting destruction for a specified length of time before being consumed in a fire.

A fire door is intended to serve multiple purposes. First, the door protects a structure from the unimpeded spreading of a fire. In addition, the door can also create a means of egress for occupants trapped behind the door when the door is deployed to its closed position, as well as providing passage for emergency personnel, such as firefighters, to enter the structure for the purpose of evacuating stranded occupants and to fight the fire.

In order to meet these demands a fire door must be resistant to fire. It must also be operable when power to the structure is discontinued since the supply of electrical power is often terminated upon detection of a fire. The door must be capable of being opened and/or possess a means of egress so as to permit trapped occupants sufficient space to exit. In addition, it must be capable of being closed again after being opened to continue to contain the fire.

Folding doors for insulating purposes have been known for some time. U.S. Pat. No. 4,106,544 to Dixon et al. discloses a single accordion shaped door. The door is made of hinged panels which are operated via an electric operating means so that the panels are folded into a vertically stacked arrangement when the door is opened and arranged in a flat position when closed. Theses doors are known to form effective sound, light and air seals. Optionally, they can be equipped with pass through or "egress" doors. The electric operating system performs a closing operation that does not require a manual assist. However, these doors are not known to be fire retardant or resistant and rely on electric means to open and close.

Double panel accordion shaped fire doors suitable for providing fire and smoke protection are known. In U.S. Pat. No. 3,509,934 to Smart, a double panel accordion type fire door is disclosed having a hollow core with interconnected parallel door sections and a lead post roller and track assembly for deploying the door. Due to the double panel construction, the door is relatively heavy making it difficult or impossible to move manually, such as to reopen the door to escape a fire after the door has been deployed to a closed position. Furthermore, the complex structure and design result in greater manufacturing costs for both materials and construction.

Some fire doors have a closing and opening actuator which is either battery operated or which uses a battery back-up system. However, in a fire situation, the battery may fail to operate. In addition, a battery must also be monitored and maintained in order to be available when needed. It is therefore desirable to have a fire door that may be readily opened and closed manually without requiring a power assist of any kind.

A single folding shutter fire door made of steel and supported by a scissors-like gate on one side is known (Model no. 1450, sold by Sano Manufacturing, Memphis, Tenn. and manufactured by Shutter Doors, Ltd.). The door is guided and supported by the scissor gate which is attached directly to the door panels. One disadvantage of this door is that it does not satisfy certain fire code requirements due, at least in part, to the structure having the actuator operate on the gate which is exposed to the environment as it is attached to the exterior of one side of the door. The actuating means is thus vulnerable to deformation upon exposure to elevated temperatures and/or fire. A further disadvantage of this door is that due to the gate mechanism being used to actuate closing of the door, excess weight and resistance are added to the door. As a result, once closed, this door is difficult to reopened manually.

U.S. Pat. No. 5,542,460 to McKeon discloses a rolling fire door which includes a self-closing mechanism and a speed regulating means so as to safely deploy the door without the necessity for an auxiliary power supply (i.e., a battery) which may be rendered inoperative in conditions of fire. This door is stored in a rolled condition and is unrolled to close an opening. Due to this configuration, a relatively large area is required adjacent to the door for storing it when not in use. In instances where space is limited, such as elevator shaft entries and the like, these doors are impractical.

There is presently a need for fire doors having sufficiently durable and lightweight construction to permit a person trapped inside a building to be protected from exposure to smoke, heat and fire as well as to exit through the fire door without the assistance of an electrically or battery operated mechanism. It is further necessary for a fire door to allow a firefighter to both reopen the fire door for access to the other side in order to perform fire fighting and rescue activities as well as to close the door once more to again provide fire protection after fire fighting and rescue activities are performed and/or aborted.

Recently promulgated fire regulations now require newly-constructed elevator entryways to be protected with an appropriately rated fire door. These areas typically do not have sufficient space to accommodate a traditional fire door such as a rolling door. In addition, the doors must allow a means of egress. However, the elevator shaft entryway will similarly not accommodate a fire door having an egress door installed in the fire door. There is presently a need for a fire door which occupies minimal space and which can be operated manually to allow a means of egress. This is especially true for protection of elevator entryways.

SUMMARY OF THE INVENTION

It is an object of the present invention to overcome the limitations of the prior art.

Another object of the present invention is to provide a fire door that affords adequate protection against fire, heat, and smoke, is not reliant on an exterior power source to be reopened and is easy to reopen after it has been closed.

It is a further object of the present invention to provide a fire door that does not require excessive storage space when not in use.

It is yet a further object of the present invention to provide a door that is lightweight and simple in construction while providing sufficient fire protection.

Briefly stated, the present invention is directed to an accordion fire door including an accordion member having a plurality of interlocking panels formed of a fire retardant or fire proof material, guide means positioned on at least one side of the accordion member for guiding the member during movement between an opened position and a closed position, and releasing means operatively connected to the accordion member for releasing the accordion member in response to a predetermined condition of at least one of heat, fire, smoke, manual initiation and a drive means upon activation of the releasing means, the fire door is deployed to a closed position.

In a preferred embodiment, a plurality of end locks are arranged at interconnected ends of adjacent panels for maintaining panel alignment. In another preferred embodiment, the panels are self hinged along their entire interlocking sides.

According to the invention, a door resistant to fire is made in the form of a single panel accordion door constructed of fire resistant material which, when closed, will prevent fire and smoke on one side of the door from reaching the other side of the door for a period of at least one hour. (i.e., meeting fire tests in compliance with, for example, NFPA 252 standard entitled *Standard Methods of Fire Tests of Door Assemblies*, 1999 Edition), while at the same time allowing for a means of egress for evacuees and a means of access and/or egress for firefighters.

The fire door of the present invention is capable of providing substantial protection against heat, smoke and/or fire and meeting national and international fire rating code requirements without being constructed with either a double accordion structure or a scissors gate support structure. In a preferred embodiment, the inventive fire door does not require auxiliary power to be deployed but utilizes gravity for this purpose, and can be readily reopened and reset after being deployed.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views, the present invention is described in schematic form as follows.

DETAILED DESCRIPTION OF THE PRESENTLY PREFERRED EMBODIMENTS

Figure 1:
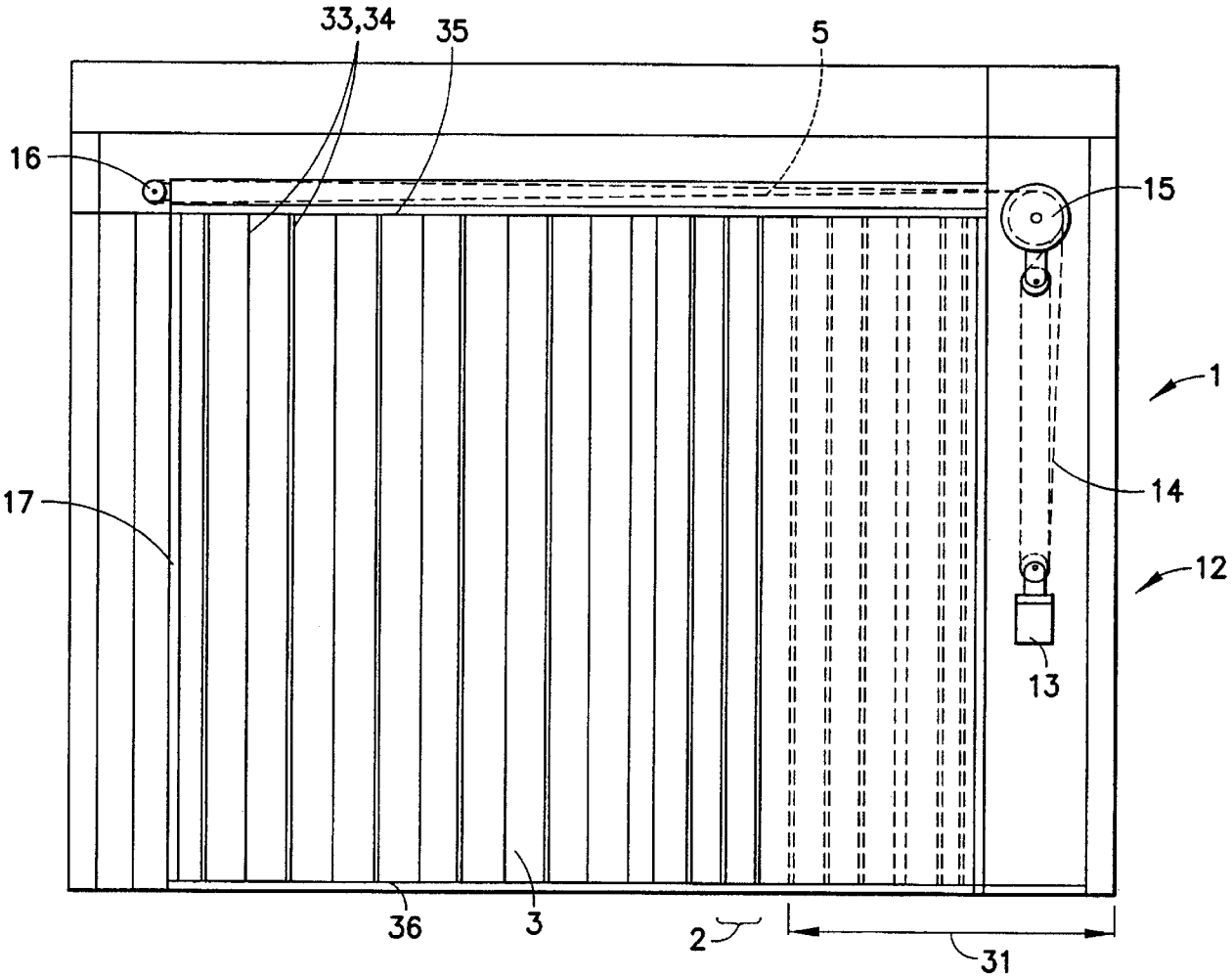
FIG. 1 shows a front view of a fire door according to an embodiment of the present invention.
Figure 3:
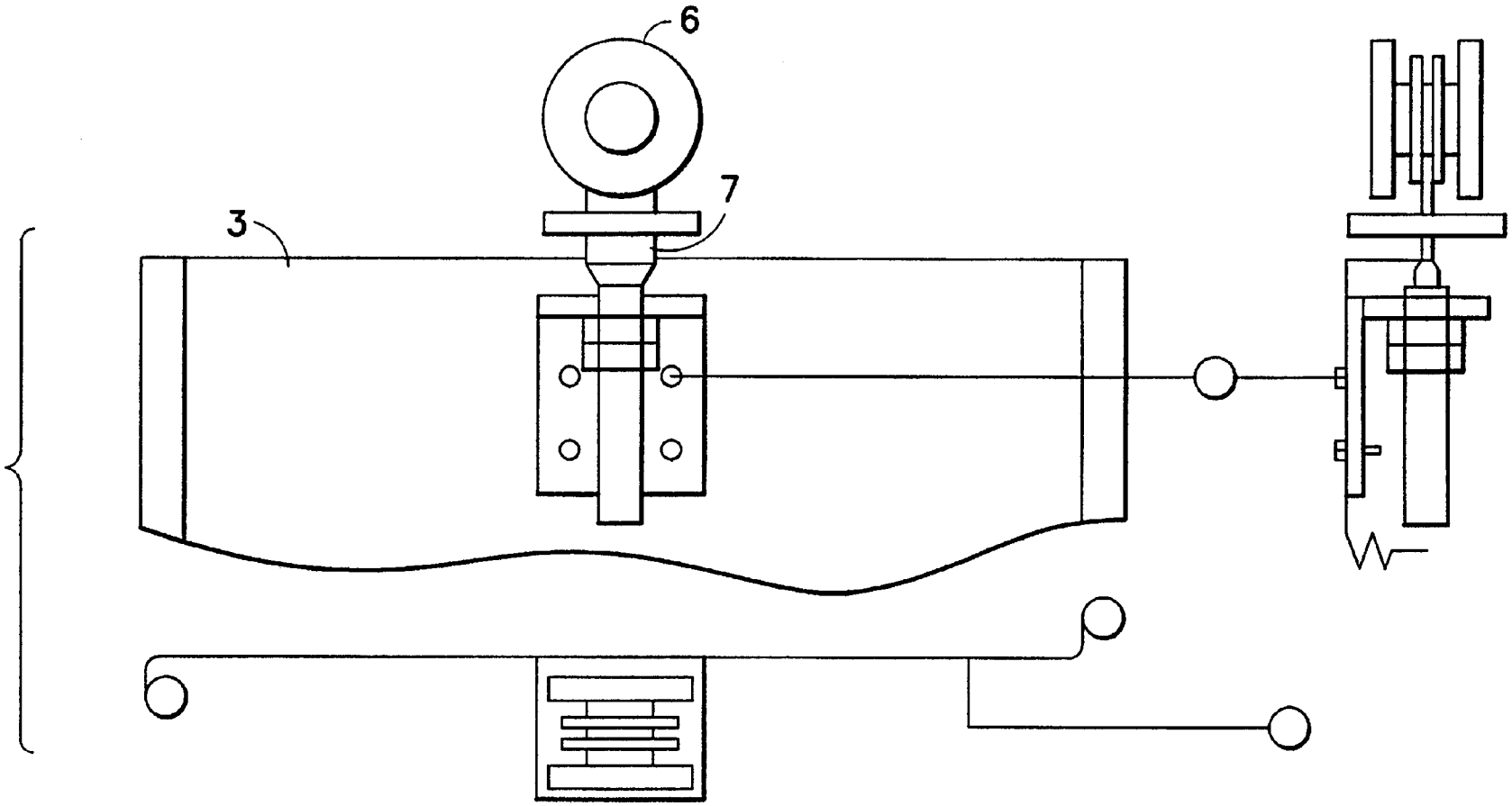
FIG. 3 depicts a detailed view of the end locks used in the inventive door.
Figure 4:
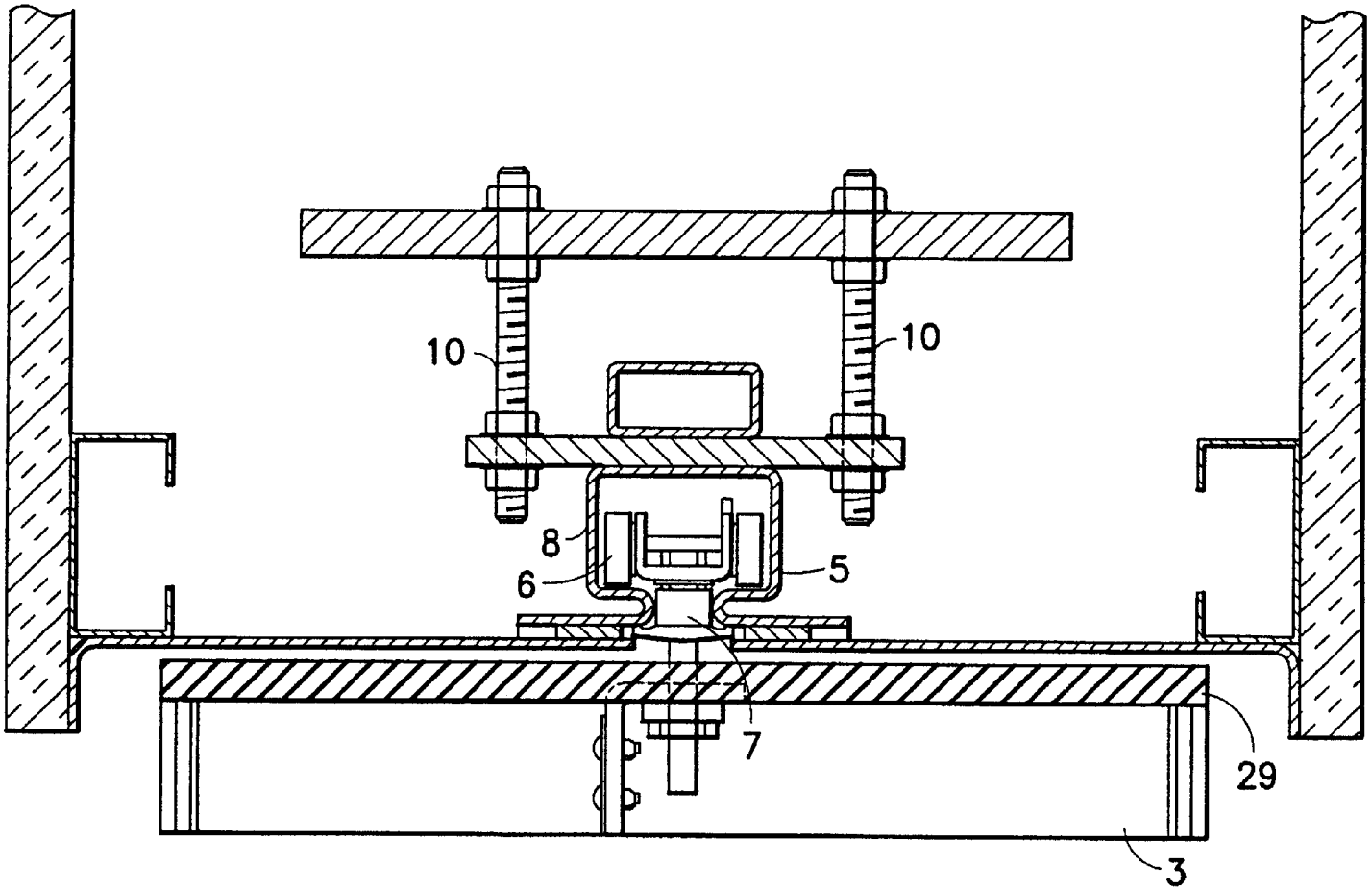
FIG. 4 is an end section view of a track for deploying the door of the present invention.

Referring now to FIG. 1, an illustrated embodiment of the accordion fire door system is shown. The door 1 is made of a curtain 2 formed of a plurality of interconnected panels 3 having a pair of opposed vertical edges 33, 34 and a pair of opposed horizontal edges 35, 36. The panels interlock with each other such that a vertical edge of one panel connects, in pivoting engagement with, to a vertical edge of an adjacent panel. The interlocked panels 3 may, optionally, include end locks 4 connected across the horizontal edges of adjacent panels for maintaining panel alignment. The accordion fire door 1 is arranged to traverse along an upper track 5. In the case of a horizontally closing door, the track 5 is disposed along a top of an opening across which the curtain 2 is disposed. The track is secured to the top of the opening by bolts or hangers 10 (FIG. 4). A plurality of glides or rollers 6 (shown in FIG. 3) connect the curtain 2 to the track 5 to maintain alignment of the curtain along the track as the curtain is moved between an open or undeployed state wherein the opening is exposed, and a closed or deployed state wherein the opening is obstructed or sealed. When in an undeployed state, the curtain is held open in any known manner using a releasing means such as a magnetic actuator, i.e., a solenoid, as discussed in U.S. Pat. No. 5,542,460, the entirety of which is herein incorporated by reference. The panels 3 may be made of any fire proof or fire retardant material rated according to Underwriters Laboratory (UL) and/or National Fire Protection Association (NFPA). The panels are preferably made of steel, preferably galvanized steel or stainless steel. The hangers 10 may be constructed of threaded rod or other sufficiently strong metal members.

Figure 2A:
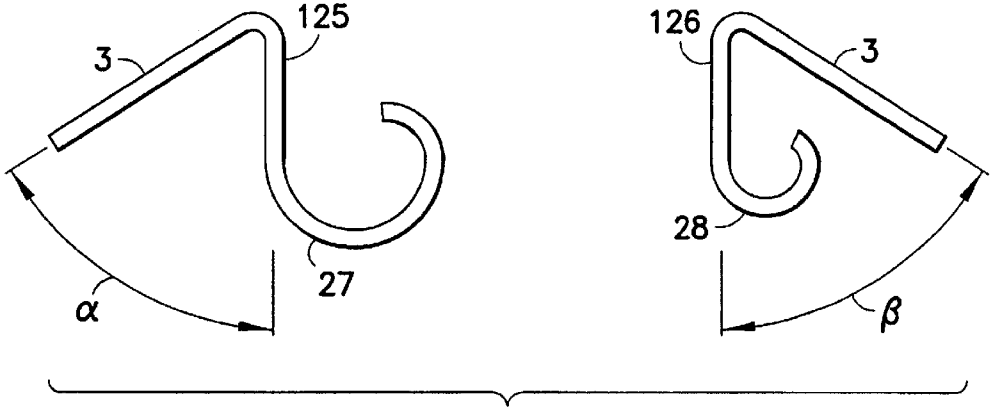
FIG. 2*a* illustrates a detailed top view of the self hinging point of attachment of adjacent panels of the fire door according to the present invention.
Figure 2B:
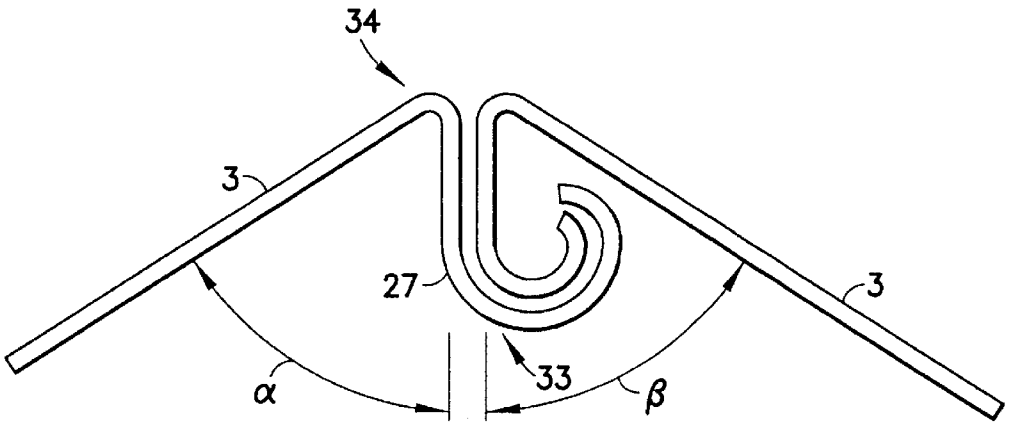
FIG. 2*b* shows a detailed top view of an alternative embodiment of the self hinging point of attachment of adjacent panels of the fire door according to the invention.

In a preferred embodiment, as best shown in FIGS. 2*a* and 2*b*, each vertical edge of each panel 3 is formed into an engagement region. Each panel has a first vertical edge 33 formed into a female hook member and an opposed second vertical edge 34 formed into a male mating hook member. Specifically, the first vertical edge of each panel is formed with a hook shank 125 at an acute angle $\alpha$ to the panel, here 57 degrees, and a reversely formed semi-circular female hook portion 27 having an inside radius of a predetermined size. The second vertical edge is formed with a hook shank 126 at an acute angle $\beta$ to the panel, here 57 degrees, and a semi-circular male hook portion 28 formed in the same direction and having a slightly smaller outside radius such that the panels can be slidably engaged with each other so that the second vertical edge 34 of one panel is received by and seats within the first vertical edge 33 of an adjacent panel. The female hook portions 27 and the male hook portions 28 engage along the entire vertical edges to form the engagement region and a pivoting axis. This engagement region also provides a necessary fire seal between adjacent panels.

Figure 5:
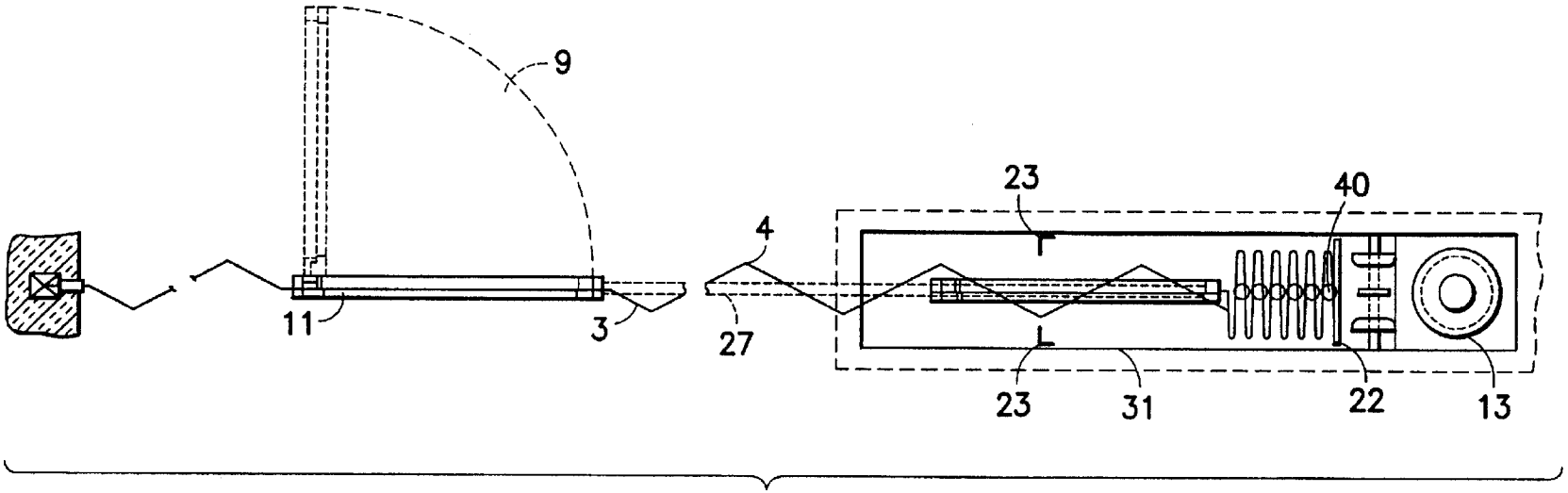
FIG. 5 is a detailed top view of an embodiment of the present invention having a swinging egress door.

As shown in FIGS. 2B and 5, the panels lie in planes which form a predetermined obtuse angle of about 114° to form a zig-zag pattern when the accordion door is closed, and pivot toward each other so that they are substantially parallel when the door is open. The hook members are designed so that the obtuse angle cannot be exceeded when the door is closed.

FIGS. 3A–3B are detailed views of a roller assembly, which includes a vertical guide roller 6 and a horizontal guide roller 7. Each roller assembly is fixed to the center of a panel, preferably every other panel. End locks secure at least one of the horizontal edges of adjacent panels together for maintaining panel alignment. In this arrangement, the need for a second track or guide to be provided along a bottom of the fire door is avoided, as the vertical position of the panels 3 relative to one another is fixed by the locks.

Referring now to FIG. 4, a detailed view of a preferred embodiment of track 5 according to the present invention is shown. As explained above, track 5 is provided for guiding movement of the panels 3 across the opening. The track is secured to a structure, such as header or top of a factory opening, by the hangers 10. The fire door 1 is suspended from and travels along a single or multiple tracks 5 using the vertical rollers 6 as explained above. The door may be further kept in alignment, for example to remain along a center of track 5, by means of horizontal rollers 7. The rollers 6, 7 are maintained in alignment by a roll formed channel 8 located centrally in the track 5. The track 5 may be made of any suitable material with which one of ordinary skill in the art is familiar. Particularly preferred are galvanized steel and stainless steel either alone or in an appropriate combination. Optionally, the fire door may be equipped with a self extinguishing neoprene seal 29 formed on one or more of the edges of the fire door 1.

Figure 6:
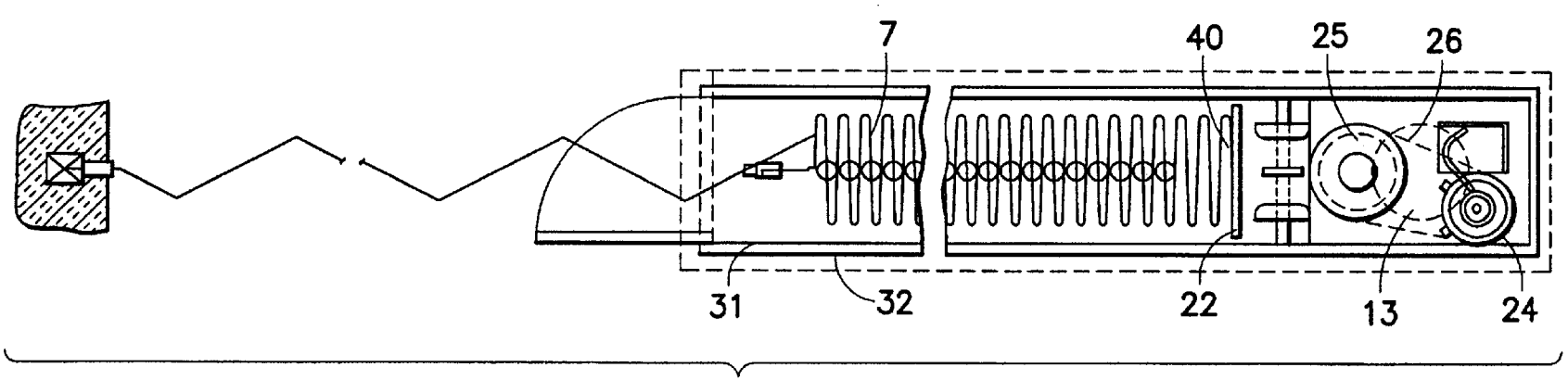
FIG. 6 is a top view of an embodiment of the present invention showing the mechanical portion of the fire door including an optional motor.

A presently preferred actuator 12 used for deploying the door to the closed position is shown in front views in FIGS. 1 and 2, and in top plan view in FIGS. 5 and 6. The actuator 12 includes a cable 14 attached at one end to a counterweight 13 and fed through one or more pulleys 15, 16 and contained within track 5. The other end of cable 14 is attached to a leading edge 17 of the door 1 through the cable 14. The cable 14 moves in response to the counterweight 13 between the pulleys to bias the door to the closed position in a known fashion. Thus, when a releasable closing mechanism, as explained more fully below, is released the door moves to the fully deployed or closed position under the influence of gravity. The speed of closure of the door is regulated by the counterweight 13, which moves in an upward direction.

With continued reference to FIGS. 5 and 6 a top view of the fire door 1 of an embodiment of the present invention is shown. As discussed above, the arrangement of the actuator 12 biases the door 1 to the closed position. Once the door is closed, the leading edge 17 of the door joins a receiving edge 21 formed, for example, in a wall defining the opening. A floating jamb 22 seals against a fire stop 23 to create a fire seal at a fixed edge 40 of the door, i.e. the edge opposite the leading edge 17, otherwise referred to as the originating end. The closed door creates the fire protection at the receiving edge 21 by a fitted contact between the leading edge 17 and the receiving edge 21 and at the originating edge 40 by the floating jamb 22 contacting the fire stop 23.

Figure 7A:
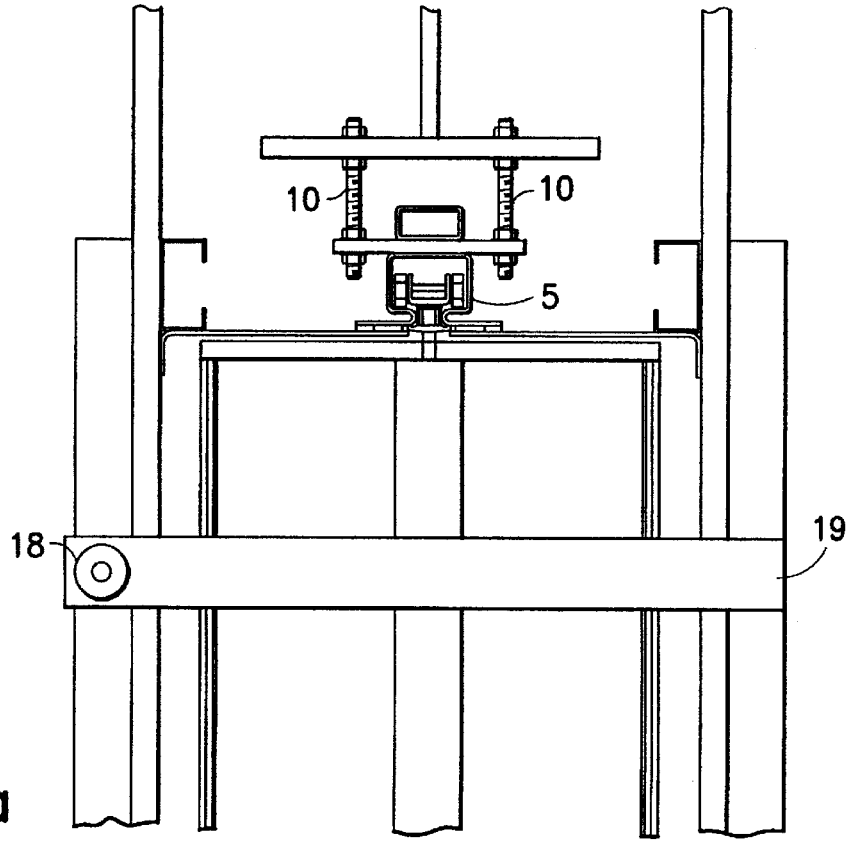
FIG. 7*a* is a partial cross sectional view of an embodiment of a releasing mechanism and guide means of the fire door according to the present invention.
Figure 7B:
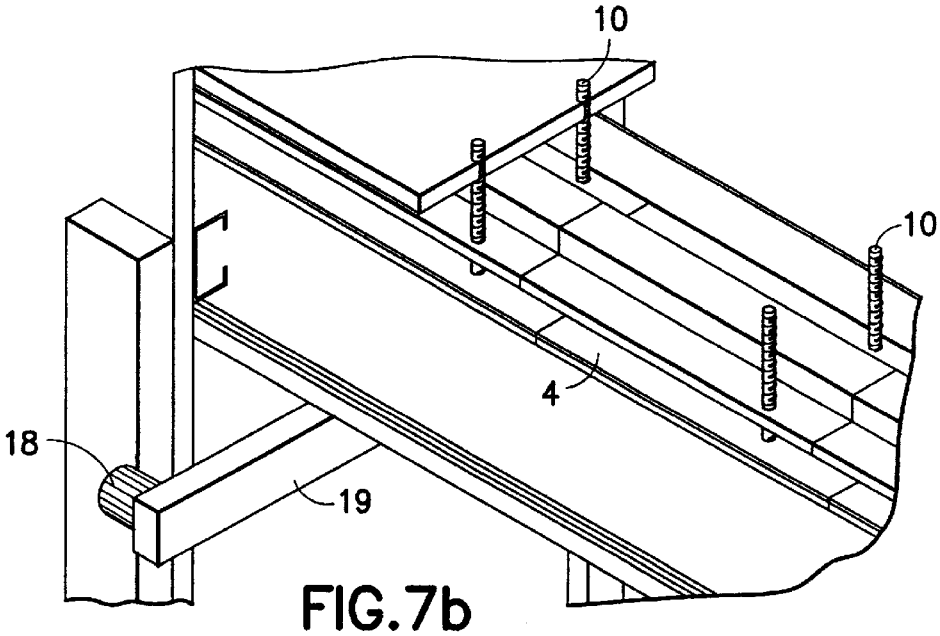
FIG. 7*b* is a perspective view of the releasing mechanism shown in FIG. 7*a;*

Referring now to FIGS. 7*a* and 7*b*, a preferred embodiment of a releasing mechanism is shown including an arm or lever 19 and a magnet 18. The arm 19 may be in the form of a metal bar or the like, and is arranged across a stack pocket 31 which holds the folded door when not in use. The arm 19 is held in a closed or obstructing position via contact with an electrically actuated magnet 18. The door is activated by a loss in power (e.g., in the event of a fire, etc.) which releases the magnetic force in the magnet 18, thereby releasing lever 19 which allows the door to close by traversing track 5. Upon power interruption, the magnet 18 releases the lever 19 allowing the door 1 to self-close i.e., under the force of gravity. The door may be quickly and easily reopened by folding the door 1 into the stack pocket 31, such as by pushing or pulling the leading edge 17 back along track 15 in a direction of the pocket 31. Once in the pocket, and assuming power has been restored to the magnet 18, the lever arm 19 can be moved back into position in contact with the magnet 18, to hold the door in place. This provides a simple reset mechanism which is an advantage over prior art folding doors. It will be appreciated that other securing mechanisms may be substituted for the magnet 18 and lever 19 arrangement discussed herein. For example, a fusible link may be used which when broken during a fire, releases the door 1 to allow it to close. It is noted, however, that the use of such a link makes resetting of the door back to its open position more difficult.

Figure 8:
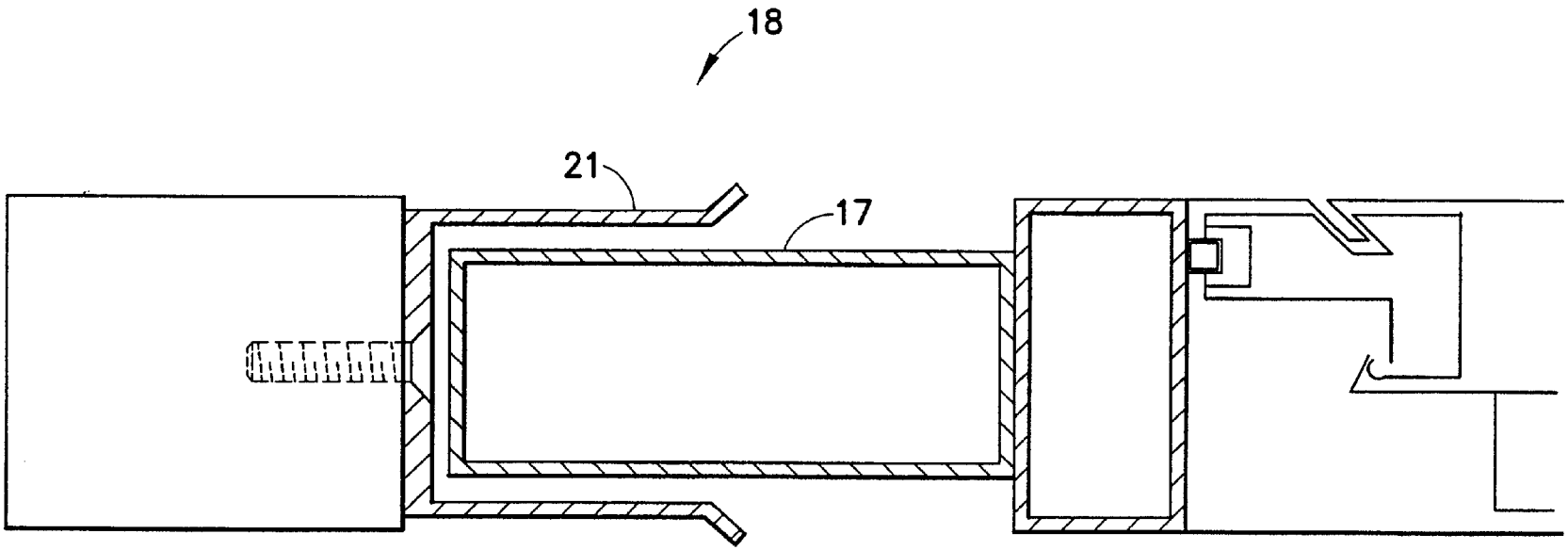
FIG. 8 is a detailed view of a leading edge of a fire door according to the present invention.

FIG. 8 shows a detailed plan view of the leading edge 17 of the fire door in accordance with the present invention. A receiving edge 21 is arranged at the building structure for accommodating the leading end 17 of the fire door 1. These materials also must be fire retardant and/or fire proof. Galvanized or stainless steel are preferred materials for these members.

Figure 9:
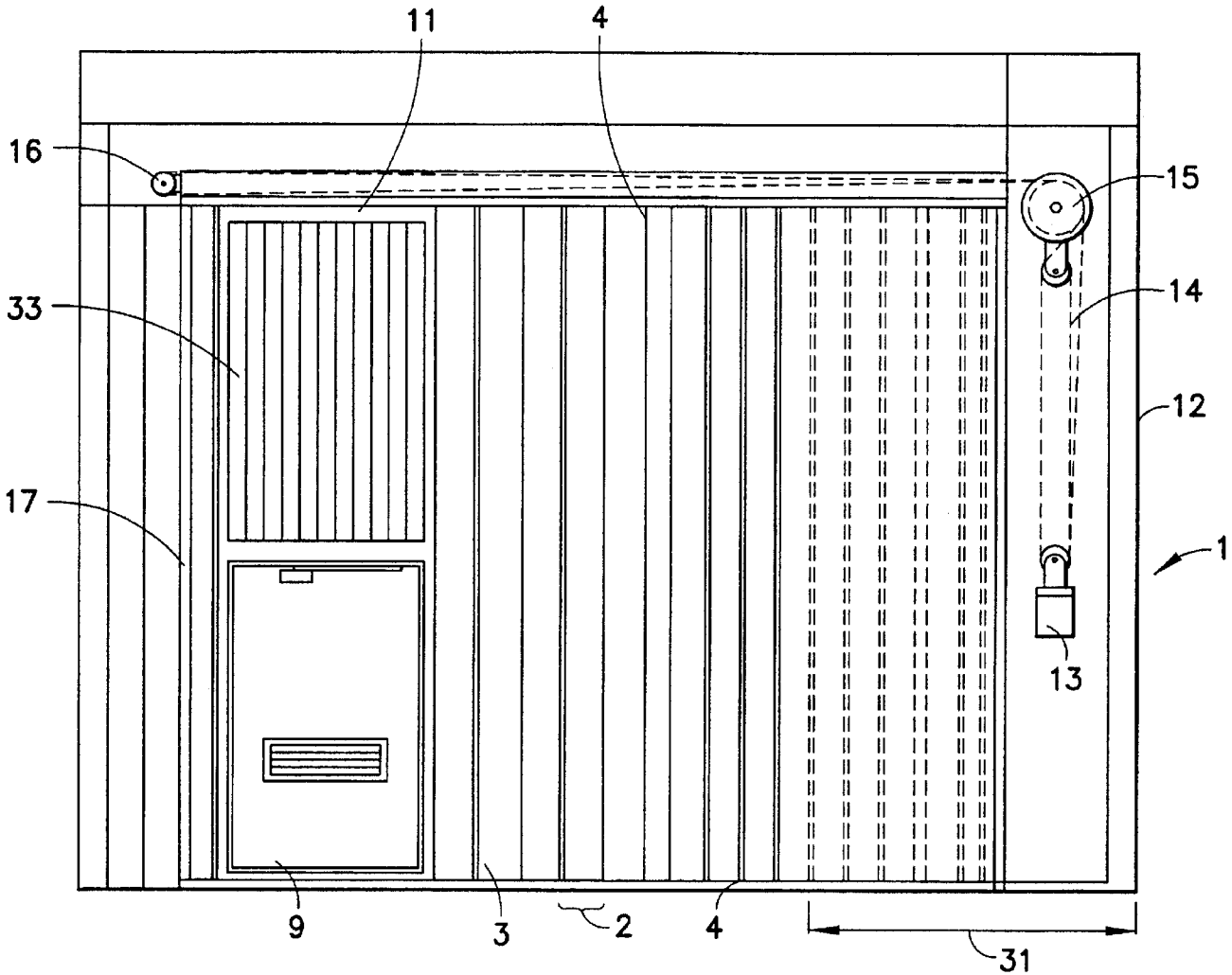
FIG. 9 is a front view of an embodiment of the present invention having a swinging door means of egress.

Referring now to FIG. 9, an embodiment of the present invention is shown which includes an egress door 9. The egress door 9, which is preferably a swinging door, is mounted to a door frame 11 formed into the panels 3 of the door 1. A transom 32 made from a fire retardant and/or fire proof material is fitted above the door frame 11. The swinging door is made of fire retardant and/or fire proof material so as to maintain the fire preventing integrity of the fire door while providing a means of egress and/or access. Thus, while it is intended that the curtain 2 can be simply pulled open to provide for egress, the inclusion of a swinging or pivoting door as well further facilitates such egress without requiring the reopening of the curtain.

If necessary, the speed of the door closure can be restricted or governed by employing known governor/brake mechanisms such as a fluid governor, an oscillation governor, a centrifugal governor or a hydraulic governor which is desirable for larger curtains. In a preferred embodiment, the door panels 3 are made of either twelve-inch or seventeen-inch wide eighteen-gauge galvanized steel panels.

Although a manual actuator 12 is presently preferred, it will be readily known to those of ordinary skill that the fire door 1 may be, alternatively, operated by a motor operator 24 as shown in FIG. 6. In this case, the motor operator 24 drives a cable drum 25 which is connected to the leading edge 17 via an additional cable 26.

The fires door of the present invention is particularly suited for use across elevator door openings. Recently enacted fire code regulations in the United States now require that elevator shaft entryways be provided with appropriately rated fire doors. The fire door of the present invention is expected to meet this need by mounting such doors in a space or pocket formed between an elevator shaft entryway and a set of elevator doors.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An accordion fire door comprising an accordion member comprising a plurality of panels each having a first vertical edge, a second vertical edge, a top horizontal edge, and a bottom horizontal edge, the first vertical edge of each panel being pivotably connected to the second vertical edge of an adjacent one of said panels, wherein said first vertical edge of each said panel has a female hook member having a hook shank formed at an acute angle to said panel and a female hook portion formed on said hook shank away from said panel, said female hook portion having a semicircular crosssection with an inside radius, and said second vertical edge has a male hook member having a hook shank formed at an acute angle to said panel and a male hook portion which is received in said female hook portion of an adjacent panel to pivotably connect said first and second vertical edges of adjacent panels, said male hook portion being formed on said hook shank toward said panel, said male hook portion having a semicircular cross-section with an outside radius which is slightly smaller than said inside radius of said female hook portion, and wherein adjacent said panels form an obtuse angle to each other when said accordion member is in the closed position, said hook members being designed so that a predetermined obtuse angle between adjacent said panels cannot be exceeded, said predetermined obtuse angle corresponding to the sum of the acute angles of said male and female hook shanks with respect to said panels, and a plurality of guide assemblies attached to the top edges of respective panels for suspending said panels from a guide track and for guiding said panels from an open position to a closed position wherein said panels extend transversely to each other in a zig-zag pattern, one of said guide assemblies being fixed to every other one of said panels substantially centrally between the vertical edges.

2. An accordion fire door as in claim 1 further comprising end locks fixed to the top horizontal edges for maintaining vertical alignment between panels, said end locks being fixed to said panels above said pivotable connections.

3. An accordion fire door as in claim 1 wherein said obtuse angle is 114 degrees.

4. An accordion fire door as in claim 1 wherein each said guide assembly comprises a pair of horizontal rollers and a vertical roller.

5. An accordion fire door as in claim 1 further comprising a self extinguishing neoprene seal on at least one of said top and bottom edges of said panels.

6. An accordion fire door as in claim 1 wherein said actuator comprises a pulley, a cable coupled with the pulley, and a counterweight fixed to the cable.

7. An accordion fire door as in claim 1 wherein said panels are formed of steel.

8. An accordion fire door as in claim 7 wherein said panels are formed of one of galvanized steel and stainless steel.

9. An accordion fire door comprising an accordion member comprising a plurality of panels each having a first vertical edge, a second vertical edge, a top horizontal edge, and a bottom horizontal edge, the first vertical edge of each panel being provided with a female hook member having a hook shank formed at an acute angle to said panel and a female hook portion formed on said hook shank away from said panel, said female hook portion having a semicircular cross-section with an inside radius, the second vertical edge being provided with a male hook member having a hook shank formed at an acute angle to said panel and a male hook portion which is received in the female hook portion of an adjacent one of said panels to form a pivotable connection between adjacent panels, said male hook portion being formed on said hook shank toward said panel, said male hook portion having a semicircular cross-section with an outside radius which is slightly smaller than said inside radius of said female hook portion, and a plurality of guide assemblies attached to the top edges of respective panels for suspending said panels from a guide track and for guiding said panels from an open position to a closed position wherein adjacent said panels extend transversely to each other in a zig-zag pattern at an obtuse angle, one of said guide assemblies being fixed to every other one of said panels substantially centrally between the vertical edges, said hook members being designed so that a predetermined obtuse angle between adjacent said panels cannot be exceeded, said predetermined obtuse angle corresponding to the sum of the acute angles of said male and female hook shanks with respect to said panels.

10. An accordion fire door as in claim 9 wherein said panels are formed of steel.

11. An accordion fire door as in claim 10 wherein said panels are formed of one of galvanized steel and stainless steel.

12. An accordion fire door installation comprising an overhead guide track, an accordion member comprising a plurality of panels each having a first vertical edge, a second vertical edge, a top horizontal edge, and a bottom horizontal edge, the first vertical edge of each panel being pivotably connected to the second vertical edge of an adjacent one of said panels, wherein said first vertical edge of each said panel has a female hook member having a hook shank formed at an acute angle to said panel and a female hook portion formed on said hook shank away from said panel, said female hook portion having a semicircular cross-section with an inside radius, and said second vertical edge has a male hook member having a hook shank formed at an acute angle to said panel and a male hook portion which is received in said female hook portion of an adjacent panel to pivotably connect said first and second vertical edges of adjacent panels, said male hook portion being formed on said hook shank toward said panel, said male hook portion having a semicircular cross-section with an outside radius which is slightly smaller than said inside radius of said female hook portion, and wherein adjacent said panels form an obtuse angle to each other when said accordion member is in the closed position, said hook portions being designed so that a predetermined obtuse angle between adjacent said panels cannot be exceeded, said predetermined obtuse angle corresponding to the sum of the acute angles of said male and female hook shanks with respect to said panels, and a plurality of guide assemblies attached to the top edges of respective panels for suspending said panels from said guide track and for guiding said panels from an open position to a closed position wherein said panels extend transversely to each other in a zig-zag pattern, one of said guide assemblies being fixed to every other one of said panels substantially centrally between the vertical edges.

13. An accordion fire door installation as in claim 12 further comprising end locks fixed to the top horizontal edges for maintaining vertical alignment between panels, said end locks being fixed to said panels above said pivotable connections.

14. An accordion fire door installation as in claim 12 wherein each said guide assembly comprises a pair of horizontal rollers and a vertical roller, said guide track comprising a channel in which said horizontal rollers and said vertical roller are received.

15. An accordion fire door installation as in claim 12 further comprising a stack pocket and an actuator, said accordion member being stored in said stack pocket in the door open position, said actuator comprising an electromagnet on one side of the stack pocket and a metal bar pivotably attached to another side of the stack pocket, said metal bar being released from said electromagnet when power to the magnet is discontinued.

16. An accordion fire door installation as in claim 15 wherein said actuator comprises a pulley, a cable coupled with the pulley, and a counterweight fixed to the cable.

17. An accordion fire door installation as in claim 12 further comprising a self extinguishing neoprene seal on at least one of said top and bottom edges of said panels.

18. An accordion fire door installation as in claim 12 wherein said panels are formed of one of galvanized steel and stainless steel.

19. An accordion fire door installation as in claim 12 wherein there is no guide track adjacent to the bottom horizontal edges of the panels.

* * * * *